US007328478B2

(12) United States Patent
Jenkins

(10) Patent No.: US 7,328,478 B2
(45) Date of Patent: Feb. 12, 2008

(54) REGISTER INLET APPARATUS FOR A CENTRAL VACUUM CLEANING SYSTEM

(76) Inventor: Bradley E. Jenkins, 2909 Sunnystone Way, Raleigh, NC (US) 27613

( * ) Notice: Subject to any disclaimer, the term of this patent is extended or adjusted under 35 U.S.C. 154(b) by 243 days.

(21) Appl. No.: 10/905,414

(22) Filed: Jan. 3, 2005

(65) Prior Publication Data

US 2006/0143851 A1 Jul. 6, 2006

(51) Int. Cl.
*A47L 5/38* (2006.01)

(52) U.S. Cl. ..... 15/301; 15/314; 15/315; 454/270; 454/284; 454/289; 454/330

(58) Field of Classification Search ..... None
See application file for complete search history.

(56) References Cited

U.S. PATENT DOCUMENTS

| | | | | |
|---|---|---|---|---|
| 1,162,151 | A * | 11/1915 | Fitts et al. | 15/314 |
| 1,228,931 | A * | 6/1917 | Kirk | 454/284 |
| 2,725,113 | A * | 11/1955 | Fagyas | 55/431 |
| 2,984,856 | A | 5/1961 | Hunt et al. | |
| 3,027,587 | A | 4/1962 | Bierstock | |
| 3,027,588 | A | 4/1962 | Bierstock | |
| 3,655,927 | A | 4/1972 | Samuelson | |
| 3,994,528 | A | 11/1976 | Humphrey | |
| 4,336,427 | A | 6/1982 | Lindsay | |
| 4,758,170 | A | 7/1988 | Hayden | |
| 5,111,841 | A | 5/1992 | Houston | |
| 5,205,013 | A | 4/1993 | Lopes | |
| 5,279,016 | A | 1/1994 | Klassen | |
| 5,408,721 | A | 4/1995 | Wall | |
| 5,504,967 | A | 4/1996 | Graham | |
| 5,886,299 | A | 3/1999 | Ward | |
| 6,671,924 | B1 | 1/2004 | Rood | |

* cited by examiner

*Primary Examiner*—David Redding
(74) *Attorney, Agent, or Firm*—Alston & Bird LLP

(57) ABSTRACT

An inlet apparatus for central vacuum cleaning systems is described that can be integrated with registers commonly used with heating and air conditioning vents in residential or commercial buildings. In particular, the apparatus opens to provide a vacuum inlet that will either remove debris directly, or through an attached hose, using the suction provided by the connected conventional central vacuum cleaning system. The apparatus contains a register body and an inlet that can be integrated with the conventional pipe ductwork used for central vacuum cleaning systems. The apparatus will seal closed when not in use in order to provide full suction to any other inlet currently in use.

11 Claims, 11 Drawing Sheets

REGISTER INLET APPARATUS FOR A CENTRAL VACUUM CLEANING SYSTEM

BACKGROUND OF THE INVENTION

This invention relates to central vacuum cleaning systems, specifically to an inlet that can be integrated with registers commonly used with heating and air conditioning vents in residential or commercial buildings.

Central vacuum cleaning systems are becoming more common in residential housing and commercial buildings. Central vacuum cleaning systems are comprised of a main power and debris receptacle usually located in a remote location such as a basement or garage, a system of pipe ductwork which extends beneath the floor and between the walls to inlets located throughout the residential or commercial unit, and a hose with an assortment of wands or brush attachments. A provision is made for each inlet to automatically seal closed when not in use in order to provide full suction to any other inlet currently in use.

Central vacuum cleaning systems have experienced growth in popularity due to many factors such as increased vacuum power, convenience, effect on increasing the value of a home, and decreasing the noise by locating the power unit remotely. Another driver for the recent growth of demand for central vacuum cleaning systems can be linked to the increase in consumer awareness of the dangers of indoor air quality. Recent studies by the U.S. Environmental Protection Agency indicate that indoor levels of many air pollutants may be two to five times higher, and occasionally up to 100 times higher, than outdoor levels. These are staggering figures, especially given that most people spend as much as 90 percent of their time indoors. As a result, the EPA has declared indoor air quality as one of the top five most urgent environmental risks to public health.

According to the American Lung Association, poor indoor air quality can cause or contribute to lung disease, including respiratory tract infections, asthma, and lung cancer. In addition, poor indoor air quality can cause headaches, dry eyes, nasal congestion, nausea and fatigue. The American Lung Association further reports that lung disease claims close to 335,000 lives in America every year and is the third leading cause of death in the United States. Over the last decade, the death rate for lung disease has risen faster than almost any other major disease. It is also estimated that as much as 25 percent of the United States population suffers from allergy symptoms. The EPA studies show that asthma is the leading chronic illness of children in the United States, afflicting 6.3 million children. The studies also show that asthma deaths and the number of Americans diagnosed with asthma continue to increase each year, afflicting over 20 million Americans and causing nearly 2 million emergency room visits and nearly half a million hospitalizations due to asthma.

As a result of the increased awareness of the importance of home air quality to public health, consumers are increasingly looking for products with recent enhancements such as high-efficiency particulate air, HEPA, and ultra-low penetration air, ULPA, filters in an attempt to trap pollutants. Unfortunately, high efficiency filters such as HEPA and ULPA do not adequately solve the problem of poor air quality in the home. The air pollutants trapped by these filters remain in the home until the filter is otherwise disposed of or cleaned. This means the pollutants could remain in the home for months depending upon replacement or cleaning intervals. In addition, during the filter replacement or cleaning process, the consumer is directly exposed to the pollutants.

To address the deficiencies in the traditional filtration approaches for removing air pollutants, consumers have turned to central vacuum cleaning systems. These systems are often recommended for allergy sufferers because they can prevent allergens from being re-circulated inside the home. In addition, central vacuum cleaning systems are recommended for reducing triggers for asthma such as microscopic dust mites, pollen, and animal dander. The Environmental Health Center of the National Safety Council recommends keeping the house clean by using a vacuum system that can be vented to the outside of the residence, such as a central vacuum cleaning system. Dirt and pollutants are sucked through the pipe ductwork to the main unit located away from the living areas of the residence. The debris can then be stored in a bag or directly exhausted outdoors, preventing the consumer from inhaling any vacuum emissions.

Central vacuum cleaning systems provide a clear step towards maintaining a clean and healthy environment in the home. However, the price and complexity of installation make such systems difficult for the majority of consumers to obtain. In most cases, professional installation is required due to the complexity of installing the pipe ductwork through the walls and floors of an existing home. This adds significant cost to the system, making them accessible primarily to the upper end housing industry. Home builders are beginning to recognize the growing awareness of central vacuum cleaning systems, and have begun to pre-pipe upper end new construction homes for these systems in an effort to provide additional value to potential buyers. While this decreases the system installation cost for the buyer of a new construction home, it does not solve the problems faced by consumers in existing homes or less costly new homes who must still pay the high installation charges to have their home retrofitted for a system. In addition, central vacuum cleaning systems are mostly permanent installations in that only the main power and debris receptacle could potentially be moved from one residence to another. The consumer would not be able to relocate the numerous inlets and extensive pipe ductwork that have been permanently installed throughout the walls and floors. In making the decision to purchase a central vacuum cleaning system, the consumer must consider issues such as property ownership and the length of planned residence to determine if a system should be installed.

Current inlets for central vacuum cleaning systems do not adequately attempt to simplify or decrease the cost of system installations. These inlets are illustrated in U.S. Pat. No. 5,408,721 to Wall; U.S. Pat. No. 5,504,967 to Graham; U.S. Pat. No. 5,886,299 to Ward; U.S. Pat. No. 4,758,170 to Hayden; and U.S. Pat. No. 5,111,841 to Houston. Each of them must be mounted to a wall, baseboard, or floor in the home. Consequently, a skilled professional must be used to retrofit an existing home for a central vacuum cleaning system due to the complexity of running pipe ductwork through floors and walls to be connected to these inlets. There is therefore a need for an economical inlet that will facilitate simplistic and lower cost installations of vacuum cleaning systems.

SUMMARY OF THE INVENTION

In its basic concept this invention provides an inlet for a central vacuum cleaning system that will be simple enough for a novice or do-it-yourself consumer to install a system without the high cost of professional installation or the degree of modification required to the residence for current system installations. This invention will leverage the existing air ducts, also called register boots, used in heating and air conditioning, or HVAC, systems by coupling the traditional register with an inlet for the central vacuum cleaning system. By doing so, modifications to the structure of the residence are minimized as pipe ductwork for the central vacuum cleaning system can be fed through the register boot in the floor. This invention therefore has simplified the installation of central vacuum cleaning systems through the convenient and easy replacement of the traditional register for this new invention. It will no longer be necessary for the pipe ductwork to be installed within walls or floors in order to reach the traditional inlets, thereby eliminating any modifications to walls, baseboards, or floors as previously required by traditional central vacuum cleaning installations. In addition, by minimizing the modifications required to the residence, this invention contributes to enabling the central vacuum cleaning system to be moved from one residence to another, thereby allowing consumers to keep their investment in such systems as they relocate.

Accordingly, an object of this invention is to provide an inlet that is easy to install in either existing or new construction, residential or commercial.

Another object of this invention is to provide an inlet that will contribute to the installation of a central vacuum cleaning system with less modification to the residential or commercial structure.

Another object of this invention is to provide an inlet that will contribute to the ability to move a central vacuum cleaning system from one residential or commercial structure to another.

Further objects and advantages of this invention will become apparent from a consideration of the drawings and ensuing description.

BRIEF DESCRIPTION OF THE DRAWINGS

Reference will now be made to the accompanying drawings for a better understanding of the invention, both as to its organization and function, with the illustrations being of preferred embodiments, but being only exemplary, and in which.

DETAILED DESCRIPTION OF THE INVENTION

Figure 1:
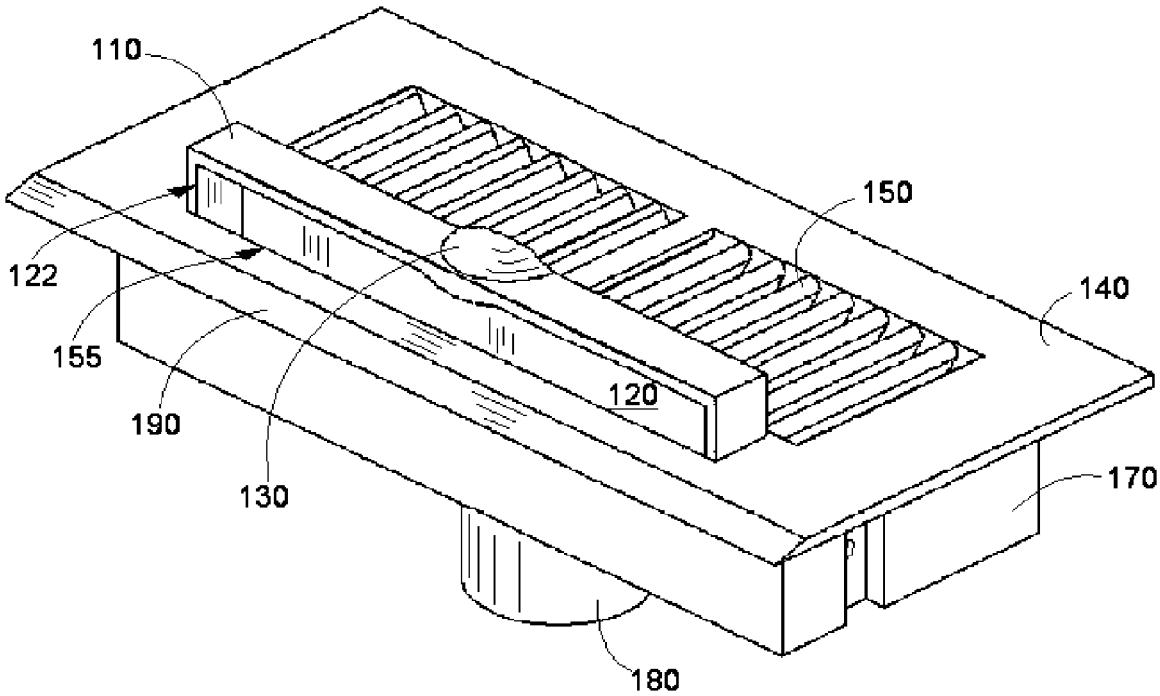
FIG. 1 is a front perspective view of a register inlet apparatus constructed in accordance with the invention and showing the inlet in its open position.
Figure 2:
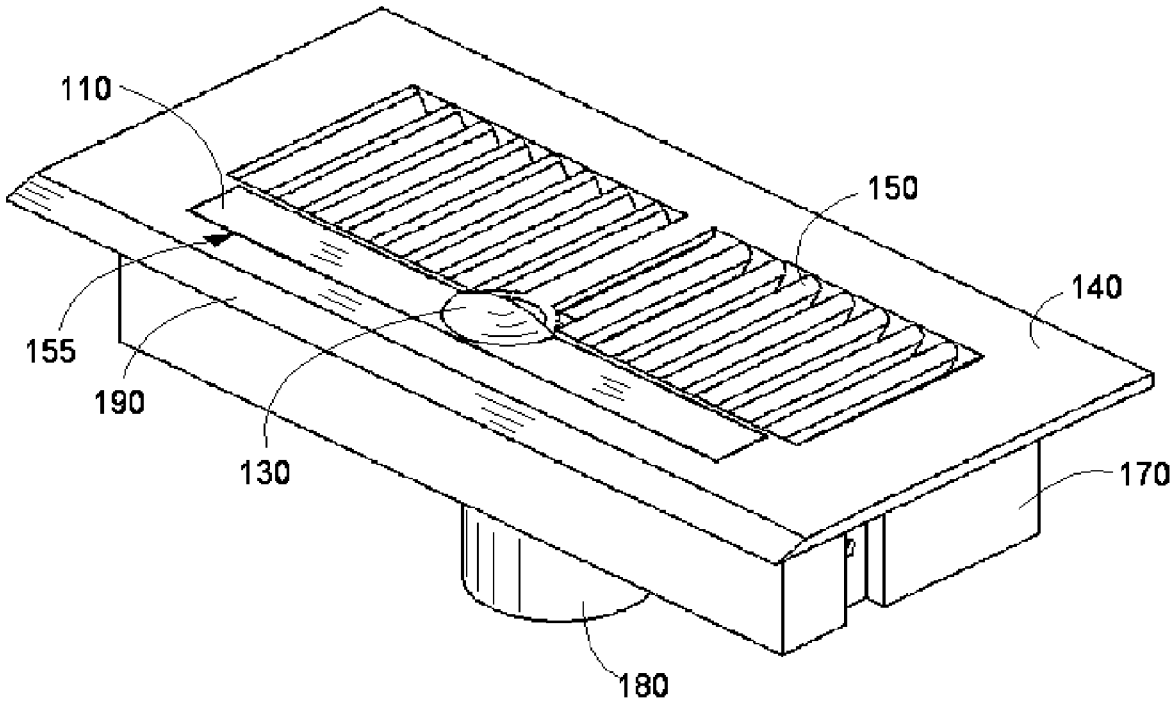
FIG. 2 is a front perspective view similar to FIG. 1 but showing the inlet in its closed position.

There is shown in FIGS. 1 and 2 a register 140 with a base 170 and illustrated air grills 150. The apparatus of this invention includes an inlet 110 which can be raised or lowered to open or close. The inlet 110 is shown in its open position in FIG. 1, and is shown in its closed position in FIG. 2. The register 140 is constructed with an opening 155 that will receive the inlet 110. The inlet 110 will have a means for lifting by way of a pull 130 such as the one illustrated. The inlet 110 will have a debris receiving chamber 120 with an opening 122 as illustrated for debris to enter. The register 140 will also have a beveled edge 190 to facilitate the movement of debris to the opening 122. It is assumed that the register 140 will also include standard regulators as commonly used to regulate the air flow through the register 140, but are not shown here in order to illustrate the inlet 110 features and integration into the register 140.

Figure 3:
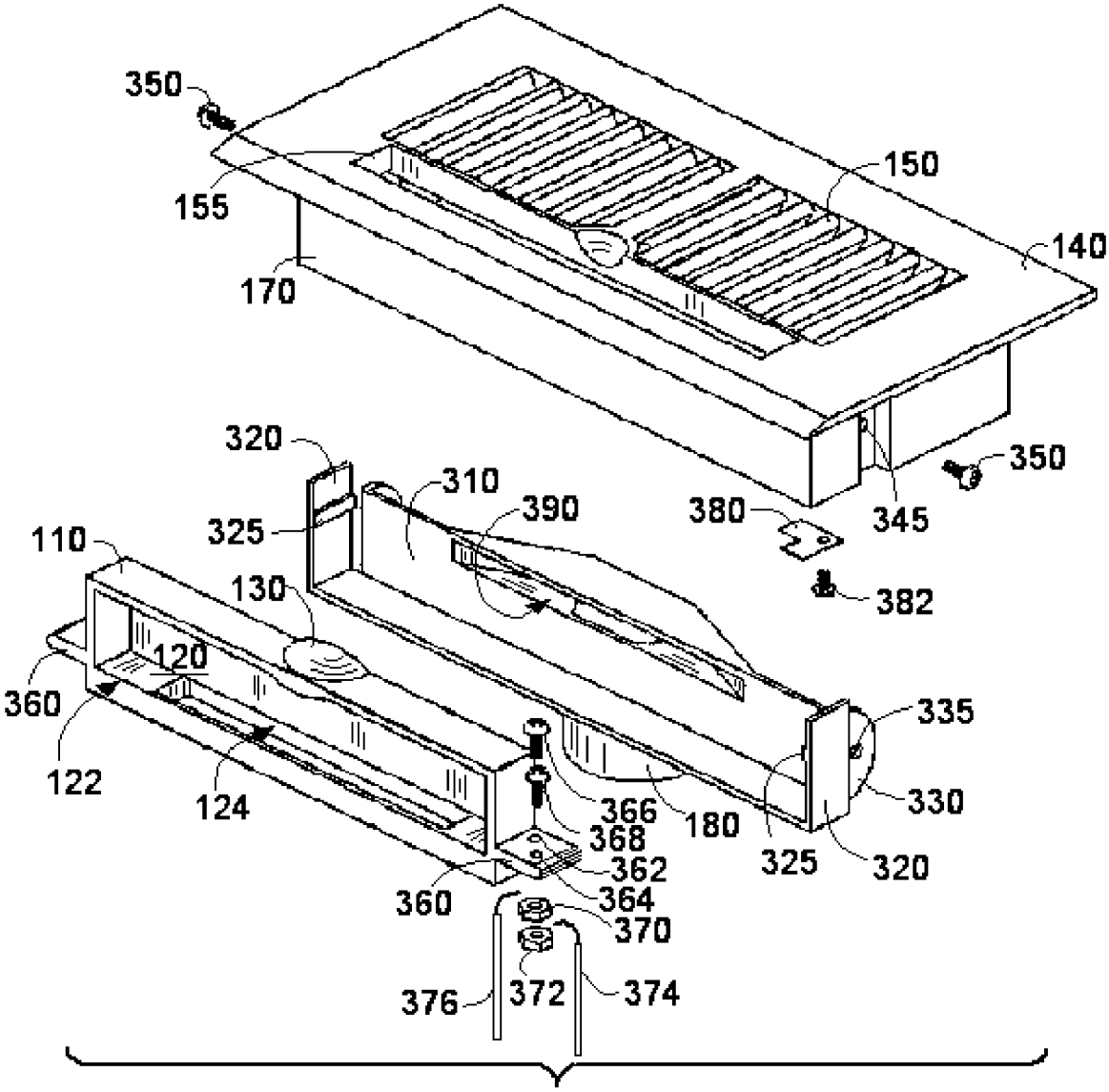
FIG. 3 is a front perspective assembly view of the register inlet apparatus showing the register base, the inlet, and the coupler from the inlet to the central vacuum pipe ductwork.

The assembly of the apparatus is illustrated in FIG. 3. The inlet 110 will sit against the wall 310 of the conduit member 180. The inlet 110 has a flange 360 on either end. These flanges will contact the side walls 320 of the conduit member 180. The conduit member 180 has a protrusion 325 on both of the side walls 320 in order to catch the flanges 360 and hold the inlet 110 in its open position. The flanges 360 will provide a stop when the inlet 110 is raised and the flanges 360 come in contact with the bottom of the register 140. The conduit member 180 will be secured into the base 170 with screws 350 which are received through the holes 335 in flanges 330 as well as the holes 345 in the base 170.

When the inlet 110 is in its open position, an opening 124 on the inlet 110 will meet with an opening 390 on the conduit member 180, and the opening 122 will be raised above the register 140 so that debris can be suctioned through the opening 122, into the chamber 120, through openings 124 and 390, and then through the conduit member 180.

When the inlet 110 is in its closed position, the opening 124 will meet with the wall 310, thus creating a seal and closing off the passageway through the opening 390. In the closed position, the inlet 110 will allow for other inlets installed in the building to receive full suction from the central vacuum cleaning system. The inlet 110 will be hidden within the base 170 so as not to present a hazard to traffic in the room.

Preferably the apparatus of the invention includes an electrical switch mechanism in the form of terminal screws 366 and 368 for closing an electrical circuit that will power on the central vacuum cleaning system. FIG. 3 illustrates one such embodiment where the terminal screws 366 and 368 are received into the flange 360 through holes 362 and 364. Electrical leads or wires 374 and 376 are secured to the terminal screws 366 and 368 using nuts 370 and 372. When the inlet 110 is raised to its open position, the terminal screws 366 and 368 will touch a contact 380, thus completing the electrical circuit and powering on the central vacuum cleaning system. The contact 380 is secured to the bottom of the register 140 with screw 382.

Figure 4:
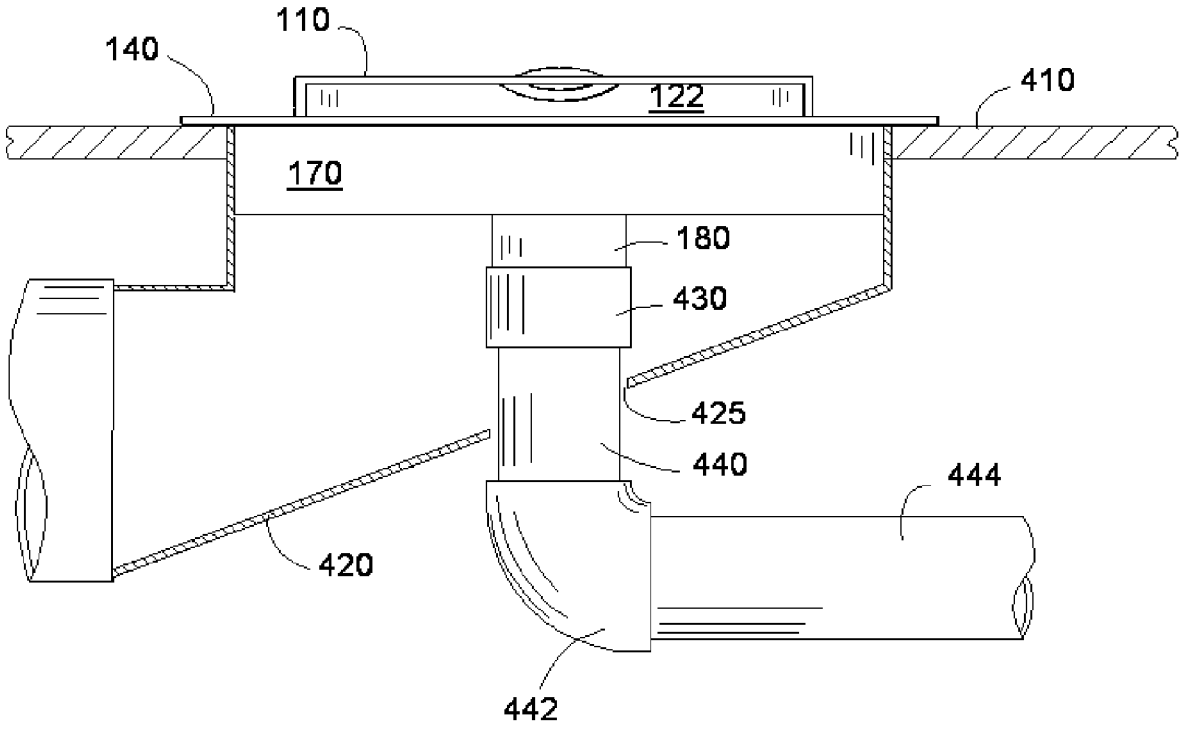
FIG. 4 is a front elevation, partly in cross section, showing how an apparatus constructed in accordance with the invention can be mounted in the register boot of a typical heating and air conditioning system.

FIG. 4 illustrates how the register inlet apparatus can be mounted in a standard register boot 420 used in heating and air conditioning systems. The base 170 will fit inside the register boot 420 with the register 140 resting on a surface 410 such as a floor. The conduit member 180 will be inside of the register boot 420, and will extend through a hole 425 created in the register boot 420. The extension of the conduit member 180 will be created using standard fittings and piping such as the fitting 430, the pipes 440 and 444, and the elbow 442. It will be understood that these standard fittings and pipes will vary based on configuration requirements to reach the central vacuum cleaning system (not shown) as well as alternative shapes or sizes of the register boot 420.

As shown in FIG. 4, debris will be suctioned through the opening 122 of the inlet 110, into the chamber 120 shown in FIG. 3, through the openings 124 and 390 also shown in FIG. 3, into conduit member 180, and then through pipes 440 and 444. Pipe 444 will then lead to a central vacuum cleaning system (not shown). It will be understood that the pipe 440 will be connected to the conduit member 180 using a standard fitting 430. It will further be understood that the pipe 440 will then be connected to additional standard fittings such as an elbow 442 and pipe 444 to lead to the central vacuum cleaning system, possibly using additional standard pipes and fittings as required.

Figure 5:
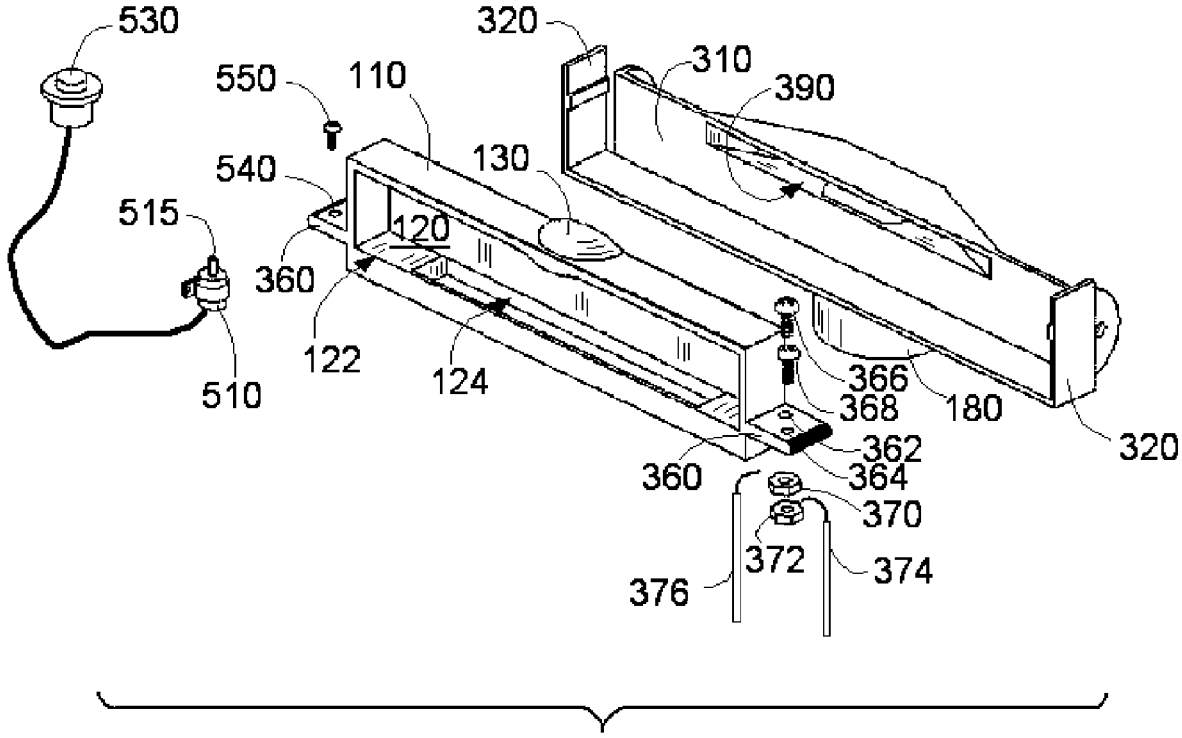
FIG. 5 is a front perspective view of an inlet similar to the one shown in FIG. 3 but illustrating an alternative solenoid embodiment of the invention.

FIG. 5 illustrates an alternative embodiment of the invention wherein the inlet 110 is moved to its open or closed position by means of a solenoid 510. The solenoid 510 is mounted to the flange 360 by use of a screw 550 placed through a hole 540 in the flange 360 and then threaded into the arm 515 of the solenoid 510. The solenoid 510 has an electrical switch 530 that when pushed will activate the solenoid 510 to move the inlet 110 to its open position. When the electrical switch 530 is pushed again, the solenoid 510 will move the inlet 110 to its closed position. The electrical switch 530 may be attached to the register 140 shown in FIG. 1, the floor 410 shown in FIG. 4, or a wall (not shown). Terminal screws 366 and 368 are again received through the holes 362 and 364 located in the flange 360. Electrical leads 374 and 376 will again be secured to the terminal screws 366 and 368 using nuts 370 and 372. When the inlet 110 is in its open position, the terminal screws 366 and 368 will touch the contact 380 as discussed previously in FIG. 3 to close the electrical circuit and power on the central vacuum cleaning system.

Figure 6:
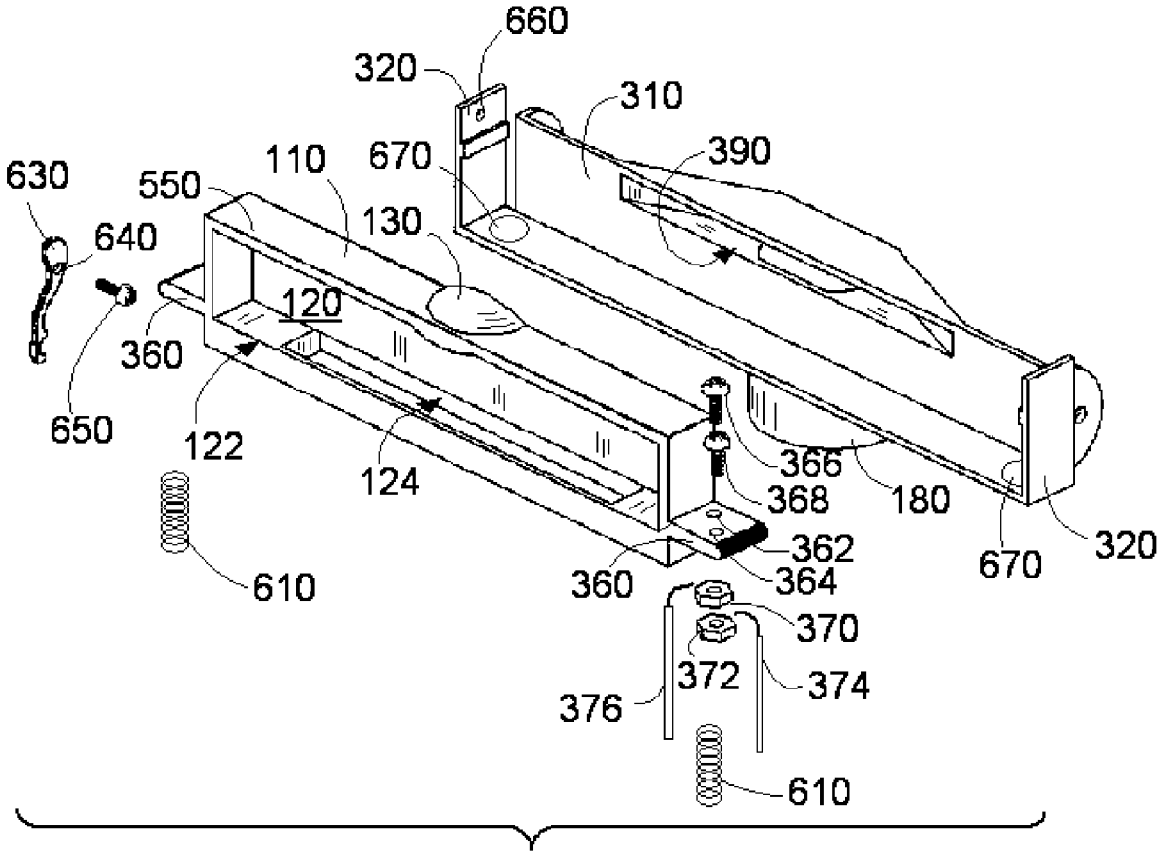
FIG. 6 is a front perspective view of an inlet similar to the one shown in FIG. 3 but illustrating an alternative spring embodiment of the invention.

FIG. 6 illustrates an alternative embodiment of the invention wherein the inlet 110 is moved to its open position by means of a spring 610 applying pressure to one or both flanges 360. The spring 610 will apply pressure between the flange 360 and the base of the conduit member 180 to push the inlet 110 in its open position. The conduit member 180 may have a recessed area 670 to prevent the spring 610 from dislodging. When the inlet 110 is pushed down to its closed position, a lever 630 will latch on the flange 360. This will prevent the spring 610 from pushing the inlet 110 up to its open position. When pushed, the lever 630 will rotate around a mounting screw 650, thus unlatching from the flange 360 and allowing the spring 610 to push open the inlet 110. The mounting screw 650 will be received through a hole 640 in the lever 630 and then threaded through the hole 660 located in the side wall 320 of the conduit member 180. Terminal screws 366 and 368 are again received through the holes 362 and 364 located in the flange 360. Electrical leads 374 and 376 will again be secured to the terminal screws 366 and 368 using nuts 370 and 372. When the inlet 110 is in its open position, the terminal screws 366 and 368 will touch the contact 380 as discussed previously in FIG. 3 to close the electrical circuit and power on the central vacuum cleaning system.

Figure 7:
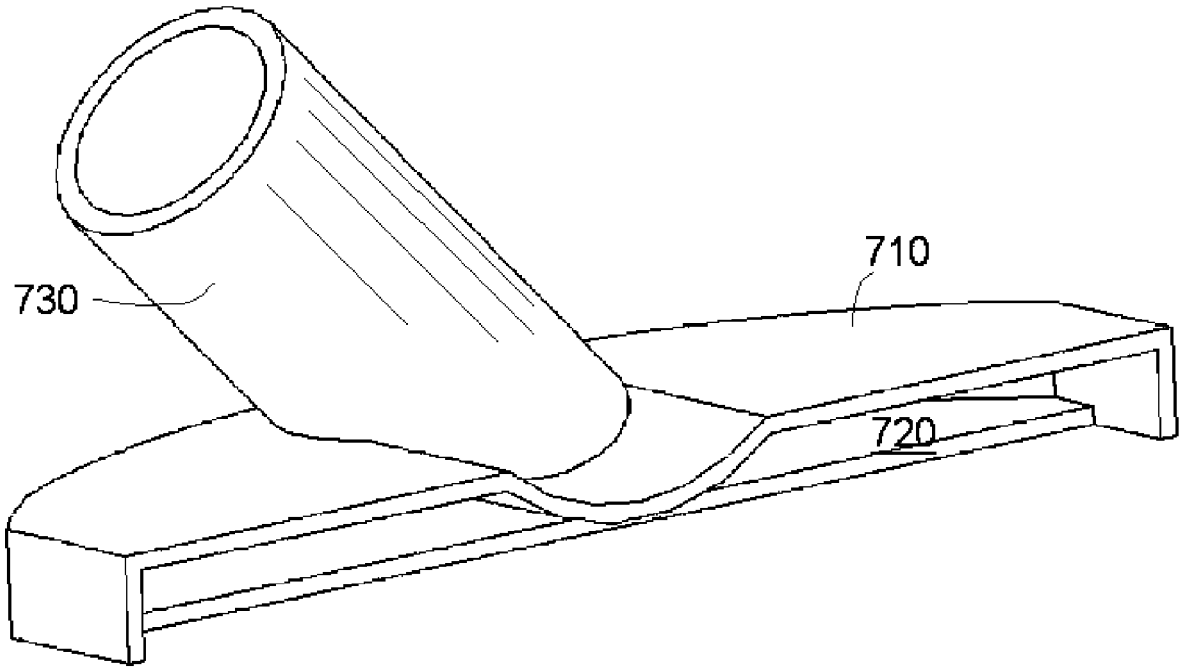
FIG. 7 is a back perspective view of an attachment that will allow a standard vacuum hose to connect to the inlet illustrated in the previous figures.

FIG. 7 illustrates an attachment body 710 that will connect to the inlet 110 illustrated in the previous figures. A standard vacuum hose (not shown) can be connected to a conduit 730 which connects to the body 710 and opens into a chamber 720.

Figure 8:
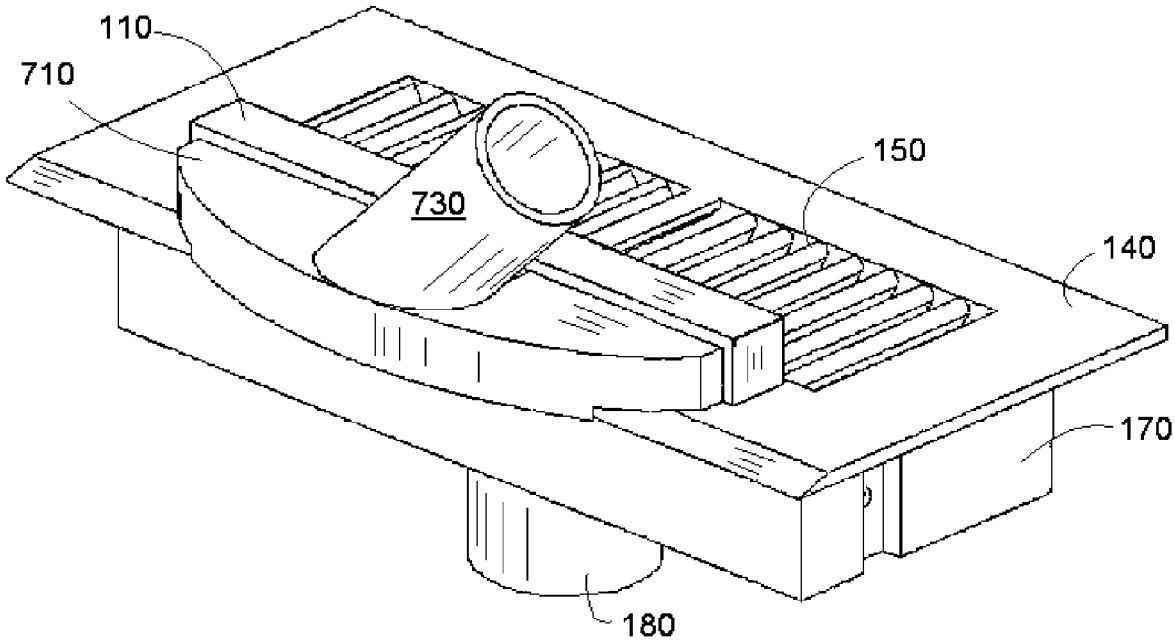
FIG. 8 is a front perspective view of the register inlet apparatus illustrating how the attachment shown in FIG. 7 could connect to the inlet.

FIG. 8 illustrates how the attachment body 710 described in FIG. 7 attaches to the inlet 110. A standard vacuum hose (not shown) can be connected to the conduit 730. When connected, debris will be suctioned through the standard vacuum hose (not shown), into the conduit 730, and into the inlet 110. From the inlet 110, debris will be suctioned through the path discussed in previous figures to the central vacuum cleaning system.

Figure 9:
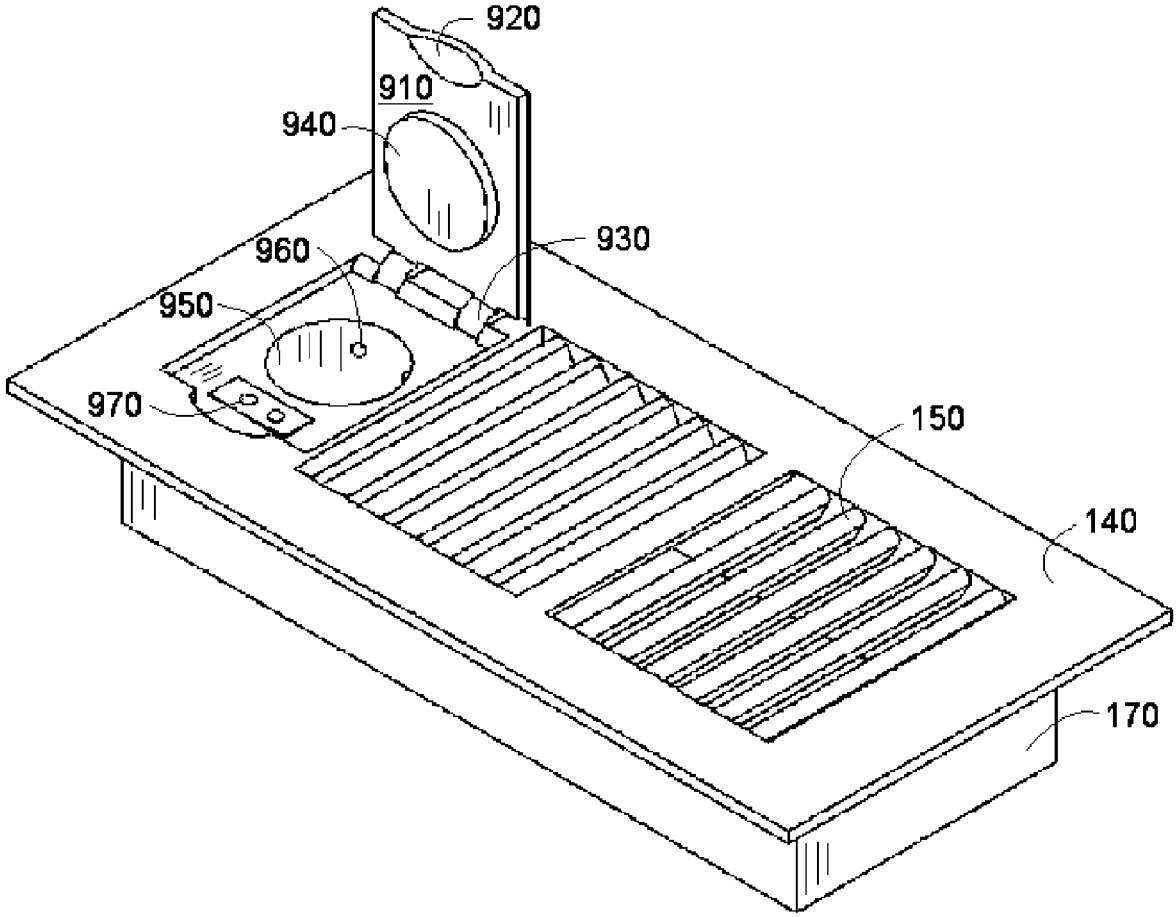
FIG. 9 is a front perspective view of the register, showing an alternative inlet embodiment, with an inlet cover in an open position, wherein a standard vacuum hose could be connected to the integrated inlet.

FIG. 9 illustrates an alternative inlet embodiment wherein a standard vacuum hose (not shown) can be inserted into an inlet 950 which is shaped to receive a standard vacuum hose cuff (not shown) and is integrated into the register 140. This embodiment can be opened by lifting a cover 910 which is connected to the register 140 using hinges 930. The cover 910 can have a method to lift, such as a pull 920 as illustrated. When the cover 910 is closed, a protrusion 940 will facilitate a sealed connection to the inlet 950 such that full suction will be provided to any other inlet that may be in use (not shown). The inlet 950 may also have spring loaded contacts 960 as shown. When the metallic end of a standard vacuum hose (not shown) is inserted into the inlet 950, the spring loaded contacts 960 will close the circuit and power on the central vacuum cleaning system. This embodiment may also have electrical leads 970 which could provide power to standard vacuum hoses with electrical capability for powered accessories (not shown). It is assumed that the register 140 will also include standard regulators as commonly used to regulate the air flow through the register 140, but are not shown here in order to illustrate the inlet 950 features and integration into the register 140.

Figure 10:
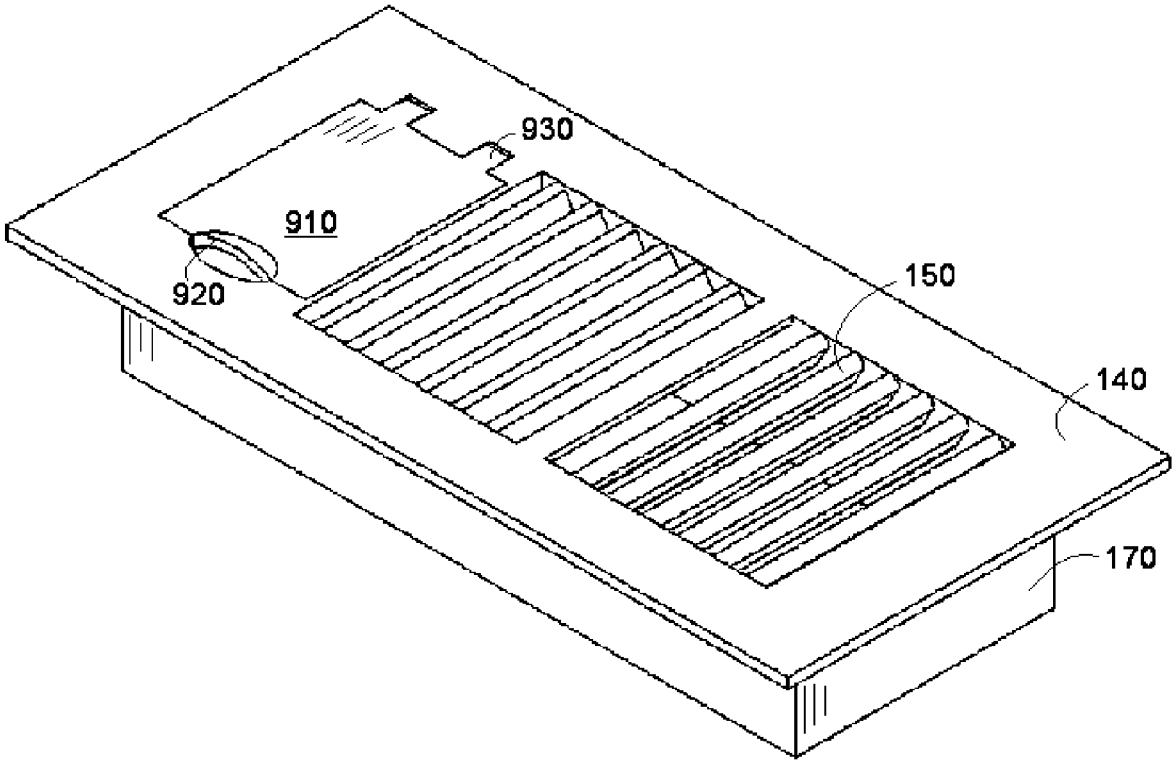
FIG. 10 is a front perspective view of the register inlet embodiment of FIG. 9, but with the inlet cover in a closed position.

FIG. 10 illustrates the same embodiment shown in FIG. 9, but with the cover 910 shown in a closed position.

Figure 11:
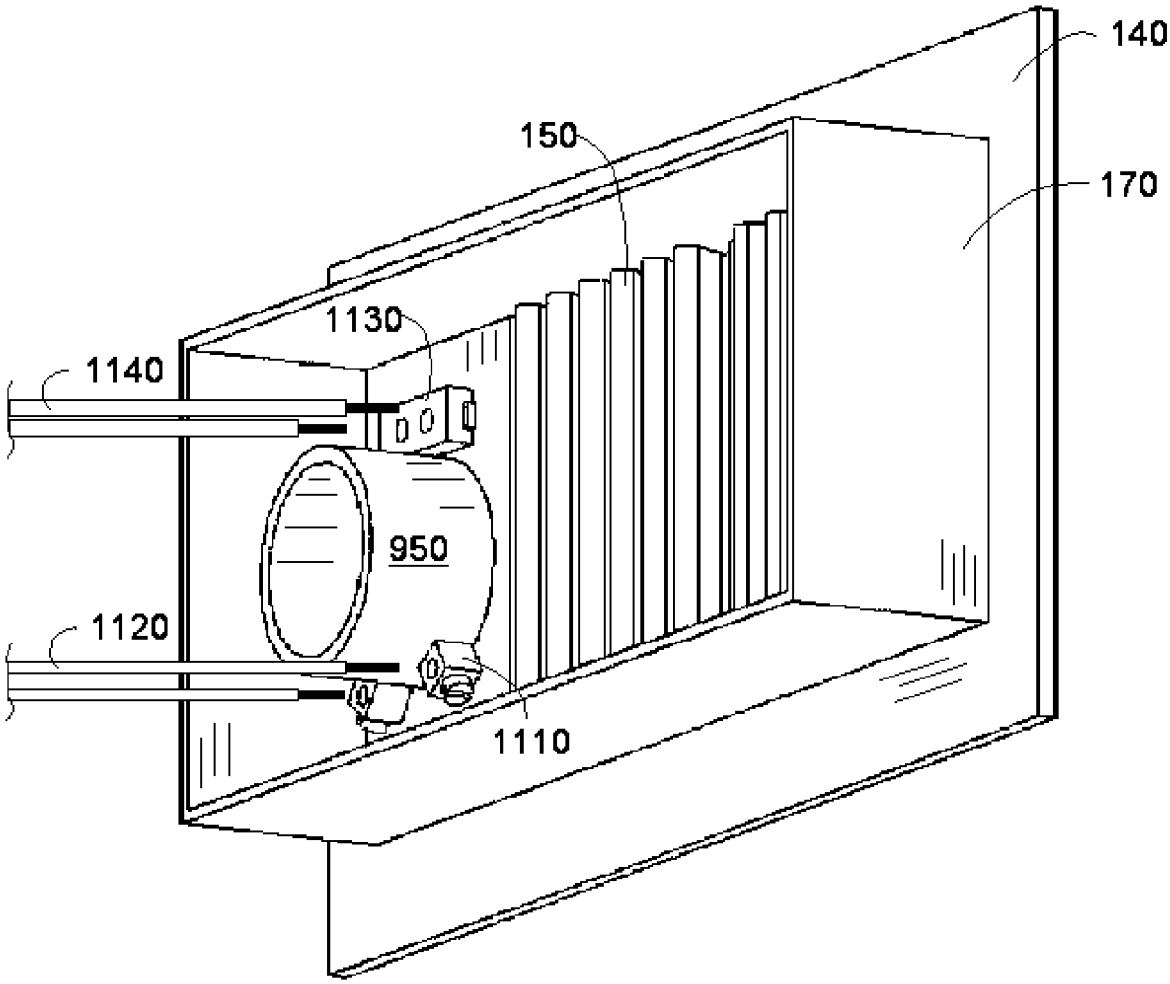
FIG. 11 is a bottom perspective of the register inlet embodiment of FIG. 9, showing how the pipe ductwork and electrical wiring could be attached.

FIG. 11 illustrates how the electrical leads and piping from the central vacuum cleaning system can be connected to the bottom of the register 140. Standard piping (not shown) can be connected to the inlet 950 to lead back to the central vacuum cleaning system (not shown). To remotely power on the central vacuum cleaning system, low voltage leads 1120 can connect to the terminals 1110 as shown. When a standard vacuum hose (not shown) is inserted into the inlet 950, the metallic end of the hose will contact the spring loaded contacts 960 as shown in FIG. 9, and complete the circuit through the low voltage leads 1120. To provide power to any standard accessories attached to the other end of the vacuum hose (not shown), electrical leads 1140 can be connected to a terminal block 1130 as shown. Standard hoses with electrical wiring can then be inserted into the inlet 950, while making contact with the electrical leads 970 as shown in FIG. 9 in order to provide power to any standard accessories attached to the other end of the vacuum hose (not shown).

It will be apparent to those skilled in the art that various modifications and changes can be made to the described register inlet apparatus without departing from the spirit and scope of this invention. Accordingly, all such modifications and changes are intended to be included as part of this invention.

What is claimed is:

1. A means for integrating an inlet for a central vacuum cleaning system into a register body commonly used in heating and air conditioning systems, comprising:

an inlet having a chamber for receiving debris that can be raised to an open position and lowered to a closed position;

a main register body commonly used in heating and air conditioning systems having a cavity for accepting said inlet;

a means for said inlet to receive pipes and pipe fittings for connecting to a central vacuum cleaning system; and an electrically operated solenoid operatively raising said inlet to said open position and lowering said inlet to said closed position.

2. A combined HVAC register and central vacuum system inlet, comprising:

a register comprising (a) a generally planar face plate of rectangular plan shape, the face plate defining a grill extending across an HVAC register opening defined through the face plate, the face plate further defining a central vacuum system inlet opening therethrough separate from the HVAC register opening, the face plate having a front side and a rear side and having first, second, third, and fourth edges, and (b) a base connected to the rear side of the face plate and defining a duct for connection to an HVAC register boot, the duct being connected to the HVAC register opening in the face plate;

a central vacuum system inlet assembly connected with the face plate, the inlet assembly comprising (1) an inlet defining a debris chamber therein, an entrance opening defined in a front side of the inlet leading into the debris chamber, and an exit opening leading out from the debris chamber, the inlet having a top wall, and (2) a conduit member fixedly secured to the register and defining an intake opening and an exit opening for connection to piping leading to a central vacuum unit;

the inlet being connected to the register such that the inlet is movable relative to the register between a closed position in which the entrance opening of the inlet is closed by walls of the register, and an open position in which the top wall of the inlet is extended above the front side of the face plate and the entrance opening of the debris chamber of the inlet is exposed such that suction exerted by a central vacuum unit on the exit opening of the conduit member causes debris to be suctioned through the entrance opening into the debris chamber, out the exit opening of the debris chamber and through the conduit member.

3. The combined HVAC register and central vacuum system inlet of claim 2, wherein the entrance opening of the debris chamber is proximate the first edge of the face plate when the inlet is in the opening position, and the first edge of the face plate is beveled to facilitate movement of debris to the entrance opening.

4. The combined HVAC register and central vacuum system inlet of claim 2, further comprising an electrical switch structured and arranged such that the switch is open when the inlet is in the closed position and is automatically closed by movement of the inlet to the open position.

5. The combined HVAC register and central vacuum system inlet of claim 2, further comprising a solenoid connected to an electrical switch, the solenoid being structured and arranged to move the inlet between the open position and the closed position by operating the switch.

6. The combined HVAC register and central vacuum system inlet of claim 2, in combination with an attachment body, the attachment body being structured and arranged to connect to the inlet when the inlet is in the open position, the attachment body including a conduit configured to be attachable to a vacuum hose.

7. The combined HVAC register and central vacuum system inlet of claim 2, further comprising an electrical receptacle arranged in the register for powering an accessory attached to an opposite end of a vacuum hose.

8. The combined HVAC register and central vacuum system inlet of claim 2, wherein the inlet slides up and down between the open and closed positions, and wherein an upper surface of the top wall of the inlet is generally flush with the front side of the face plate when the inlet is in the closed position.

9. A combined HVAC register and central vacuum system inlet, comprising:

a generally planar face plate of rectangular plan shape, the face plate having a front side and a rear side, the face plate defining a grill extending across an HVAC register opening defined through the face plate, the face plate further defining a central vacuum system inlet opening therethrough separate from the HVAC register opening;

a base connected to the rear side of the face plate and defining a duct for connection to an HVAC register boot, the duct being connected with the HVAC register opening in the face plate;

a conduit member fixedly secured to the rear side of the face plate and connected to the central vacuum system inlet opening in the face plate, the conduit member defining an exit opening for connection to piping leading to a central vacuum unit, the central vacuum system inlet opening and conduit member being configured to receive an end of a standard vacuum hose; and a lid pivotally connected to the face plate, the lid being movable between a closed position in which the lid seals only the central vacuum system inlet opening closed such that the HVAC register opening remains open, and an open position in which the central vacuum system inlet opening is open for receiving an end of a standard vacuum hose.

10. The combined HVAC register and central vacuum system inlet of claim 9, further comprising electrical contacts arranged in the conduit member for use in actuating the central vacuum unit when a metallic surface on an end of a standard vacuum hose makes contact with the electrical contacts so as to complete an electrical circuit.

11. The combined HVAC register and central vacuum system inlet of claim 9, further comprising an electrical receptacle connected to the face plate for powering an accessory attached to an opposite end of a standard vacuum hose.

* * * * *